US006553771B2

(12) United States Patent
Tsenter

(10) Patent No.: US 6,553,771 B2
(45) Date of Patent: Apr. 29, 2003

(54) ELECTROCHEMICAL HEAT PUMP SYSTEM

(75) Inventor: Boris Tsenter, Roswell, GA (US)

(73) Assignee: Borst Inc., Chamblee, GA (US)

( * ) Notice: Subject to any disclaimer, the term of this patent is extended or adjusted under 35 U.S.C. 154(b) by 0 days.

(21) Appl. No.: 09/728,586

(22) Filed: Dec. 1, 2000

(65) Prior Publication Data

US 2002/0066277 A1 Jun. 6, 2002

(51) Int. Cl.[7] ..... F17C 11/00
(52) U.S. Cl. ..... 62/46.2; 62/467
(58) Field of Search ..... 62/46.2, 467

(56) References Cited

U.S. PATENT DOCUMENTS

| | | | | |
|---|---|---|---|---|
| 4,118,299 A | | 10/1978 | Maget | |
| 4,402,187 A | * | 9/1983 | Golben et al. | 62/467 |
| 4,488,592 A | | 12/1984 | Mittal et al. | |
| 4,523,635 A | | 6/1985 | Nishizaki et al. | |
| 4,593,534 A | | 6/1986 | Bloomfield | |
| 4,671,080 A | | 6/1987 | Gross | |
| 4,829,785 A | | 5/1989 | Hersey | |
| 4,875,346 A | * | 10/1989 | Jones et al. | 62/467 |
| 4,939,902 A | * | 7/1990 | Retallick | 62/46.2 |
| 4,995,235 A | * | 2/1991 | Halene | 62/46.2 |
| 5,024,060 A | | 6/1991 | Trusch | |
| 5,678,410 A | | 10/1997 | Fuejita et al. | |
| 5,746,064 A | | 5/1998 | Tsenter | |
| 5,768,906 A | | 6/1998 | Tsenter | |
| 5,900,031 A | | 5/1999 | Bloomfield | |
| 6,068,673 A | | 5/2000 | Bloomfield | |
| 6,167,721 B1 | | 1/2001 | Tsenter | |
| 6,321,561 B1 | | 11/2001 | Maget | |

* cited by examiner

*Primary Examiner*—Ronald Capossela

(57) ABSTRACT

An electrochemical heat pump system comprising an electrochemical pump, refrigerant-based cooling system, and gas-driven compressor. The electrochemical pump is capable of reversibly producing and consuming hydrogen gas. The cooling system comprises a condenser, compressor, and evaporator in thermal communication with an object to be cooled. The compressor comprises a chamber having a fixed volume and a flexible separator that physically divides the chamber into a gas space and a refrigerant space containing vapor refrigerant. As hydrogen gas is produced in the gas space, the flexible separator extends into the refrigerant space thereby expanding the gas space and compressing the vapor refrigerant. As the vapor refrigerant is compressed, it is forced through the condenser where the refrigerant is liquefied. The liquid refrigerant then passes through the evaporator where the liquid refrigerant is evaporated by absorbing heat from the object to be cooled.

19 Claims, 3 Drawing Sheets

Vapor compression Rankine cycle 3-4 Isentropic compression 4-1 Isothermal condensation at constant pressure 1-2 Adiabatic expansion 2-3 Isothermal evaporation at constant pressure

ELECTROCHEMICAL HEAT PUMP SYSTEM

FIELD OF THE INVENTION

The present invention generally relates to a method and apparatus for a heat pump system, and more particularly to an electrochemical heat pump useful to compress and transfer a refrigerant.

BACKGROUND OF THE INVENTION

Cooling of different devices utilizing a vapor compression refrigeration cycle is known in the art. Vapor compression cooling uses the thermodynamic principles associated with phase transfer, specifically the latent heal of vaporization and the entropy of evaporation of a working fluid. Compression of a vaporous working fluid can occur through mechanical or electrochemical means. Mechanical compression requires a relatively large, heavy, mechanical compressor having a great number of parts which are often bulky and susceptible to wear. After compression, the heated working fluid is condensed and gives up its latent heat of vaporization to a low temperature reservoir often referred to as a heat sink. The liquefied working fluid is then expanded at constant enthalpy. The cool liquefied working fluid can be used to exchange heat with a hot element by giving up its latent heat of vaporization. This cycle is known as a Joule-Thomson refrigeration cycle.

Electrochemical compressors have been proposed to drive Joule-Thomson refrigeration cycles, such as in U.S. Pat. No. 4,593,534 by Bloomfield, which is hereby incorporated by reference in its entirety herein. The cycle uses a working fluid, at least one component of which is electrochemically active as per that patent. Another component of the working fluid is condensable. In one embodiment, the electrochemically active component is hydrogen and the condensable component is water. The electrochemical compressor raises the pressure of the working fluid and delivers it to a condenser where the condensable component is precipitated by heat exchange with a sink fluid. The working fluid is then reduced in pressure in a thermal expansion valve. Subsequently, the low pressure working fluid is delivered to an evaporator where the condensed phase of the working fluid is boiled by heat exchange with a source fluid.

The major disadvantages of that approach are penetration of refrigerant (e.g., water) vapor in the electrode stack of the pump. Indeed, the electrode stack, which contains a series of connected electrochemical cells should have a small but certain amount of water. The excess water causes low pump activity because of diffusion resistance for hydrogen penetration. The lack of water results in high impedance of the membrane electrode assembly (MEA). If the working fluid shares a common gas space with the pump, the amount of water in the pump is excessive. The water in the MEA and the working fluid has non-stop vapor exchange through the common gas space. This may create pump flooding or drying.

U.S. Pat. No. 4,829,785 by Hersey describes a cryogenic cooling system using hydrogen as a primary refrigerant fluid and oxygen as a secondary refrigerant fluid to pre-cool the hydrogen gas below its inversion temperature. The hydrogen and oxygen are cooled through the Joule-Thomson effect of adiabatic gas expansion. After the refrigeration cycle is completed, the hydrogen and oxygen electrochemically react to create water. The problems with this approach may include the small Joule-Thomson effect associated with the hydrogen and the necessity to burn the hydrogen and oxygen to water in an exothermic reaction (producing additional heat).

Also, as described in U.S. Pat. No. 4,523,635 by Nishizaki et al., which is hereby incorporated by reference in its entirety herein, it is known that certain metals and alloys exothermically occlude hydrogen to form a metal hydride. The metal hydride reversibly releases hydrogen. A heat pump (e.g., a refrigerator) may be constructed by providing a first metal-hydride ($M_1H$) and a second metal-hydride ($M_2H$), which have different equilibrium dissociation pressures at the same temperature, in closed receptacles capable of effecting heat exchange with a heat medium, and connecting these receptacles with a common gas space conduit so as to permit the transfer of hydrogen there between.

However, these types of heat exchange devices rely on differences in equilibrium dissociation pressures of the respective metal hydrides. The metal hydrides utilized must be able to occlude and release hydrogen at very substantial rates, and metal hydrides of this type are very expensive to manufacture and utilize. Additionally, it is difficult to efficiently control the production and consumption of hydrogen during operation of the heat exchanger using principles of dissociation of hydrogen from metal hydrides.

Also, as described in U.S. Pat. No. 5,746,064 and U.S. Pat. No. 5,768,906, which are both owned by Applicant and hereby incorporated by reference in their entireties herein, it is known that an electrochemical pump based on electrochemical cells can be used in a heat exchange system.

In addition, as described in U.S. application Ser. No. 09/353,458, which is owned by Applicant and hereby incorporated by reference in its entirety herein, an electrochemical hydrogen pump has been proposed for use in a number of heat exchange applications. The electrochemical heat exchanger includes a housing, hydrogen producing/consuming portions separated by a proton exchange membrane, and a gas space designed to contact an object to be cooled. The gas space includes either hydrogen or a liquid gas that is placed in thermal contact with an item to be cooled. The hydrogen gas or liquid coolant exchanges heat with the object to be cooled and is constantly replenished by hydrogen or liquid coolant forced through the heat exchanger by a pressure differential created between the respective hydrogen electrodes.

SUMMARY OF THE INVENTION

In accordance with the present invention, there is provided an electrochemical heat pump for use in a vapor refrigeration cycle that includes a hydrogen electrochemical pump, a chamber divided by a flexible separator into a gas space and a refrigeration space, and a refrigerant-based cooling system. Preferably, the hydrogen electrochemical pump is capable of producing hydrogen gas at a hydrogen electrode and consuming hydrogen gas at a first electrode thereby creating a pressure differential between the two electrodes. As hydrogen gas is produced, the hydrogen gas enters the first gas space and expands the flexible separator.

Preferably, two chambers are utilized wherein the first chamber is divided by a first flexible separator into a first gas space and a first refrigeration space, and the second chamber is divided by a second flexible separator into a second gas space and a second refrigerant space. The two chambers allow for production of hydrogen gas in the first gas space and consumption of the hydrogen gas in the second gas space.

Preferably, the flexible separators located between the gas space and the refrigerant space mechanically isolate the contents of the two spaces while keeping the contents of the two spaces in pressure contact with each other. Pressure contact is intended to mean that a pressure on one side of the separator from the contents of one of the systems will result in a deforming of the separator and a resultant increase in pressure and decrease in volume on the contents of the other system at the other side of the separator. The flexible separator used in the present invention may include a flexible diaphragm, bellow, or other device that may be used as a separator.

Preferably, the polarity of the hydrogen electrochemical pump is reversed upon receiving an input signal to create a reciprocal pump. The corresponding signal for polarity reversal may include a certain time period, a pressure differential between both sides of the separator, or a predetermined pump voltage. The polarity reversal causes a reduction reaction to take place at the first electrode of the hydrogen pump. As such reduction reaction occurs, hydrogen gas is produced at the first electrode and this hydrogen gas fills the second gas space causing the second flexible separator to expand. This completes one full cycle of the hydrogen pump.

In one embodiment, the refrigerant-based cooling system includes a first and second condenser, a first and second throttle valve, and an evaporator. As hydrogen gas is produced in the first gas space, the flexible separator expands, compresses the refrigerant stored in the refrigerant space, and forces the refrigerant through the first condenser to liquefy the refrigerant. The liquid then passes through the first throttle valve to reduce the pressure of the liquid refrigerant. The liquid refrigerant then passes through the evaporator to evaporate the liquid refrigerant by absorbing heat from an object to be cooled as latent heat of evaporation. Finally, the vapor refrigerant is pulled into the second refrigerant space. When the polarity is reversed, hydrogen gas is being produced in the second gas space causing the flexible separator to expand. When the flexible separator expands, it compresses the refrigerant stored in the second refrigerant space and forces it through the second condenser to liquefy the refrigerant. The liquid then passes through the second throttle valve to reduce the pressure of the liquid refrigerant. The liquid refrigerant then passes through the same evaporator to evaporate the liquid refrigerant by absorbing heat from an object to be cooled as latent heat of evaporation. Finally, the vapor refrigerant is pulled into the second refrigerant space. This completes one full cycle of the system.

In the preferred embodiment, the refrigerant-based cooling system includes a condenser, a throttle valve, an evaporator, and four one-directional valves used to direct the flow of the refrigerant. As hydrogen gas is produced in the first gas space, the flexible separator expands, compresses the refrigerant stored in the refrigerant space, and forces the refrigerant through the first one-directional valve and into the condenser to liquefy the refrigerant. The liquid then passes through the throttle valve to reduce the pressure of the liquid refrigerant. The liquid refrigerant then passes through the evaporator to evaporate the liquid refrigerant by absorbing heat from an object to be cooled as latent heat of evaporation. Finally, the vapor refrigerant passes through the second one-directional valve raid is pulled into the second refrigerant space. When the polarity is reversed, hydrogen gas is being produced in the second gas space causing the flexible separator to expand. When the flexible separator expands, it compresses the refrigerant stored in the second refrigerant space and forces it through the third one-directional valve and back into the condenser to liquefy the refrigerant. The liquid then passes through the throttle valve to reduce the pressure of the liquid refrigerant. The liquid refrigerant then passes through the evaporator to evaporate the liquid refrigerant by absorbing heat from an object to be cooled as latent heat of evaporation. Finally, the vapor refrigerant passes through the fourth one-directional valve and is pulled into the first refrigerant space. This completes one full cycle of the system.

BRIEF DESCRIPTION OF THE DRAWINGS

The invention is herein described, by way of example only, with reference to the accompanying drawings, wherein.

DETAILED DESCRIPTION OF THE PREFERRED EMBODIMENTS

The principles and workings of an electrochemical heat pump system according to the present invention can be better understood with reference to the drawings and the accompanying detailed description, which describes possible embodiments of the electrochemical heat pump according to the present invention.

Figure 1:
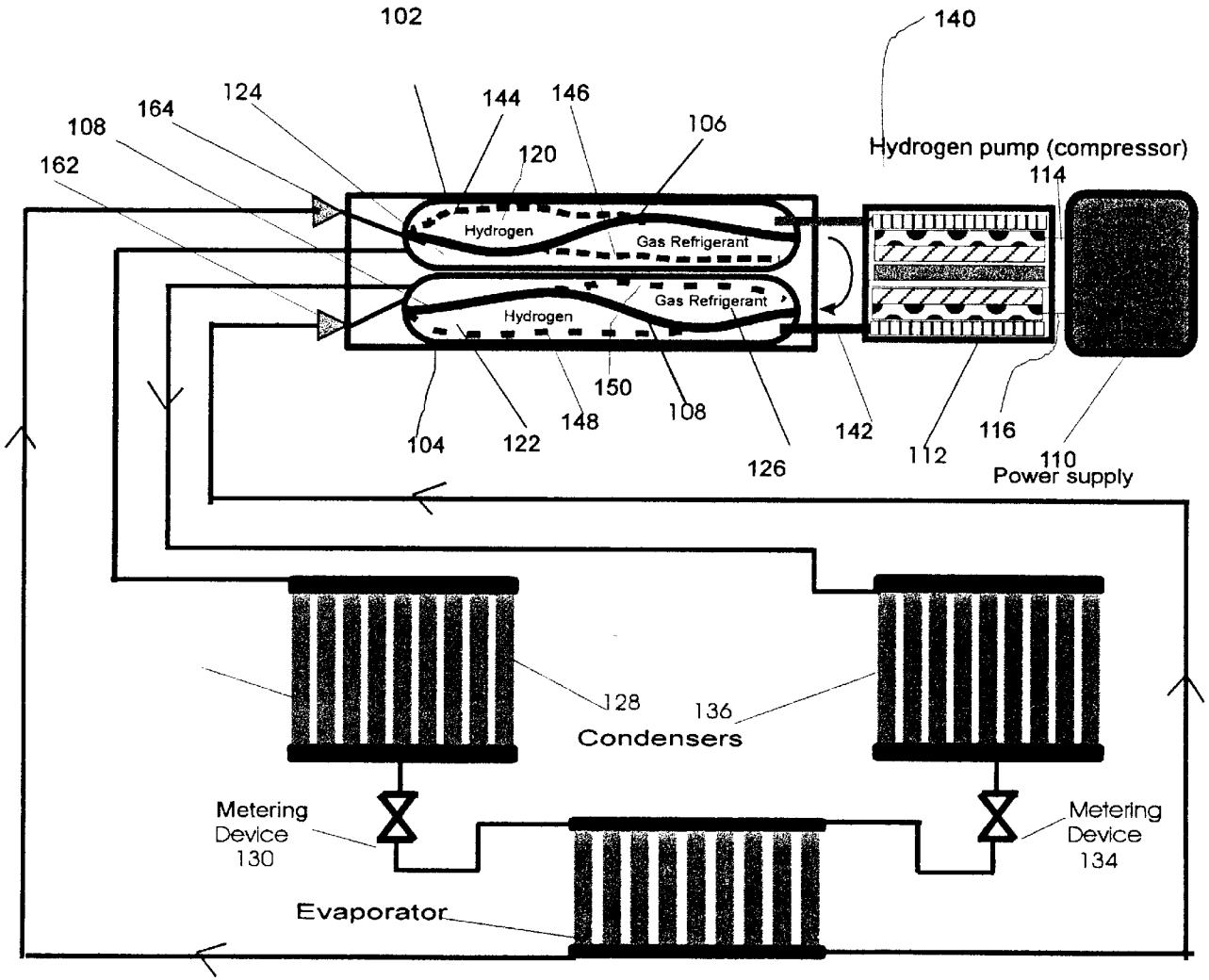
FIG. 1 illustrates a first embodiment of the electrochemical heat pump system components and operation in reciprocal mode utilizing two condensers and one evaporator.
Figure 2:
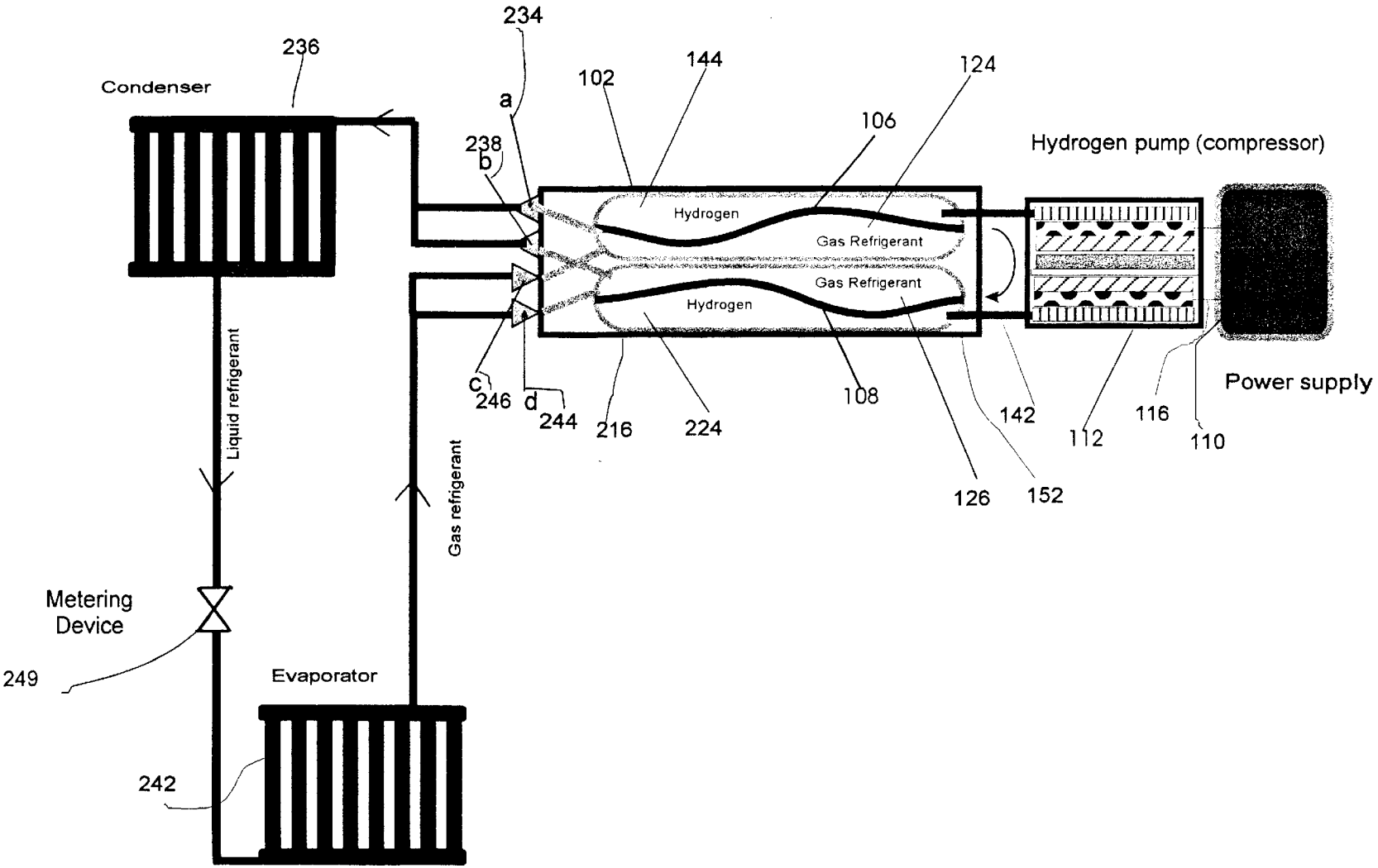
FIG. 2 illustrates a preferred embodiment of the electrochemical heat pump system components and operation in reciprocal mode utilizing one condenser, one evaporator, and four one-directional valves.

Referring now to the drawings, FIGS. 1 and 2 show a graphical representation of the components in an electrochemical heat pump system using a refrigerant. In both embodiments, the electrochemical heat pump system is comprised of an electrochemical pump 112 capable of reversibly producing and consuming gas, a refrigerant-based cooling system 154, 254, and a gas-driven compressor 152 in fluid communication with the electrochemical pump and cooling system wherein the gas produced from the electrochemical pump 112 is physically isolated from the refrigerant from the cooling system. Preferably, the electrochemical pump 112 reversibly produces and consumes hydrogen gas. As shown in FIGS. 1 and 2, both embodiments described herein include the same electrochemical pump 112 and gas-driven compressor 152 and differ only with their respective refrigerant-based cooling systems 154, 254. Therefore, because the electrochemical pump 112 and the gas-driven compressor 152 shown in FIG. 1 are identical to the electrochemical pump 112 and gas-driven compressor 152 shown in FIG. 2 and for ease of discussion, like elements in FIG. 1 are numbered identical to like elements in FIG. 2. Additionally, a discussion of the common electrochemical pump 112 and gas-driven compressor 152 that forces the refrigerant through the refrigerant-based cooling system 154, 254 follows. Once the common electrochemical pump 112 and gas-driven compressor 152 are described, the two embodiments including the details of their respective refrigerant-based cooling systems 154, 254 will be described.

The electrochemical pump 112 comprises at least one electrochemical cell separated by a membrane electrode assembly ("MEA"). The MEA is also known in the industry as a proton exchange membrane ("PEM"). Each electrochemical cell comprises a hydrogen electrode 140 and a first electrode 142. The first electrode 142 may consist of a hydrogen, metal, metal-hydride, or metal-oxide electrode.

The MEA is integrally located between the hydrogen electrode 140 and the first electrode 142 to mechanically isolate the two electrodes. In the preferred embodiment, the electrochemical pump 112 may include a plurality of MEAs connected in series mechanically isolating the hydrogen electrode 140 and first electrode 142 of each electrochemical cell. Preferably, the electrochemical heat pump system further comprises a reversible electric power supply 110 having a first electrical terminal 114 electrically connected to the hydrogen electrode 140 and a second electrical 116 terminal electrically connected to the first electrode 142.

In this invention, the hydrogen electrode 140 is utilized as a cathode to produce hydrogen gas and the first electrode 142 is utilized as an anode to consume hydrogen gas. Hydrogen gas is produced under high pressure and consumed under lower pressure. The high pressure on the production side of the pump is used for compressing refrigerant and converting vapor refrigerant to liquid mode. The low pressure on the consumption side of the pump is used for absorbing refrigerant vapor following compression. The pressure is preferably regulated by means of time and current restriction.

The gas-driven compressor 152 may include only a first chamber 102 having a fixed volume and a first flexible separator 106 dividing the first chamber 102 into a first gas space 120 and a first refrigerant space 124. However, in both embodiments as described in FIGS. 1 and 2, the gas-driven compressor 152 further comprises a second chamber 104 having a fixed volume and a second flexible separator 108 dividing the second chamber 104 into a second gas space 122 and a second refrigerant space 126. Both the first refrigerant space 124 and the second refrigerant space 126 contain a refrigerant such as freon or the like. Each flexible separator 106, 108 is a membrane that is not permeable to either hydrogen gas or the refrigerant to be used in the electrochemical heat pump system. Preferably, each flexible separator 106, 108 may be a metal diaphragm, a combination metallic and plastic diaphragm, or a plastic bellow. Each gas space 120, 122 is in fluid communication with the electrochemical pump and each refrigerant space 124, 126 is in fluid communication with the cooling system. Each gas space 120, 122 is capable of expanding when hydrogen gas is produced by the electrochemical pump and contracting when hydrogen gas is consumed by the electrochemical pump 112.

In this invention, the production of hydrogen gas in the first gas space 120 forces the first gas space 120 to expand. The expansion of the first gas space 120 causes the first flexible separator 106 to extend into the first refrigerant space 124 thereby compressing the refrigerant contained in the first refrigerant space 124. This compression forces the refrigerant out of the first refrigerant space 124 and through the cooling system. Alternately, the consumption of hydrogen gas causes the second gas space 122 to contract. The contraction of the second gas space 122 causes the second flexible separator 108 to extend into the second gas space 122 thereby expanding the second refrigerant space 126 and creating a vacuum capable of pulling the refrigerant through the cooling system, one direction valve 162, and into the second refrigerant space 126.

The electrochemical pump 112 and the gas-driven compressor, as shown in FIGS. 1 and 2, work in the following manner. When current from the power supply 110 is supplied to the hydrogen electrode 140 and the first electrode 142 of the electrochemical pump 112, hydrogen gas is produced at the hydrogen electrode 140 (cathode) in a reduction reaction and hydrogen gas is consumed at the first electrode 142 (anode) in an oxidation reaction. Hence, as hydrogen gas is produced at the hydrogen electrode 140, the first gas space 120 begins to fill with hydrogen gas. As more hydrogen gas enters the first gas space 120, the pressure inside the first gas space 120 increases. This pressure increase also increases the pressure on the face of the first flexible separator 106. Ultimately, the pressure inside the first gas space 120 will reach a point where the first flexible separator 106 will begin to flex and extend into the first refrigerant space 124 thereby expanding the first gas space 120 and compressing the refrigerant contained in the first refrigerant space 124. Such a displacement is represented by the dotted line 146 in FIGS. 1 and 2. This compression forces the refrigerant out of the first refrigerant space 124 and through the cooling system.

Likewise, a second gas space 122 and a second flexible separator 108 exist. The oxidation reaction that occurs at the first electrode 142 (anode) consumes all of the hydrogen gas that is present in the second gas space 122. Hence, hydrogen gas is pulled from the second gas space 122 into the electrochemical pump 112 where the hydrogen gas is consumed in an oxidation reaction at the first electrode 142. As more hydrogen leaves the second gas space 122, the pressure inside the second gas space 122 decreases. This pressure decrease also decreases the pressure on the face of the second flexible separator 108. Ultimately, the pressure inside the second gas space 122 will reach a point where the second flexible separator 108 will begin to flex and extend into the second gas space 122 thereby contracting the second gas space 122 and expanding the second refrigerant space 126. Such a displacement is represented by the dotted line 148 in FIGS. 1 and 2. The expansion of the second refrigerant space 126 creates a vacuum capable of pulling the refrigerant through the cooling system, one direction valve 162, and into the second refrigerant space 126.

Once the flexible separators 106, 108 reach their maximum displacements, the hydrogen pump 112 has reached the halfway point in its pumping cycle, and the polarity of the power supply 110 for the hydrogen pump may be reversed. Polarity reversal can be accomplished by a variety of different sensors that measure either the physical position of the first or second flexible separator's displacement or some other characteristic of the heat pump system. The reversal of polarity on the power supply 110 will reverse the reactions that take place at the hydrogen electrode 140 and the first electrode 142.

The polarity reversal may also correspond to a signal for polarity change which may include a predetermined time period, a pressure differential between both sides of the separator, or a predetermined pump voltage. The time signal may he based on the premise that hydrogen pressure depends on hydrogen production capacity, which is a product of current and time. The pressure signal translates the phase of the refrigerant. As soon as the refrigerant reaches the liquid phase, the polarity is preferably switched after a certain time delay. The pump voltage preferably relates to or illustrates the pressure in the consumption chamber. The voltage across the pump terminals may rise as soon as the hydrogen is depleted in the consumption chamber. The electrode polarization caused by hydrogen diffusion results in rising of terminal voltage. That phenomenon may also be used as the signal to switch the pump polarity.

After the polarity is reversed, the hydrogen electrode 140 will now consume hydrogen gas in an oxidation reaction (anode) and the first electrode 142 will now produce hydrogen gas in a reduction reaction (cathode). In general, the former cathode has become the new anode and the former anode has become the new cathode.

Because the oxidation reaction is now taking place at the hydrogen electrode 140, the hydrogen gas in the first gas space 120 will be consumed at the hydrogen electrode 140. Hence, the pressure in the first gas space 120 due to the hydrogen gas will decrease, and the pressure on the wall of the first flexible separator 106 will also decrease. This pressure decrease also decreases the pressure on the face of the first flexible separator 106. Ultimately, the pressure inside the first gas space 120 will reach a point where the first flexible separator 106 will begin to flex and extend into the first gas space 120 thereby contracting the first gas space 120 and expanding the first refrigerant space 124. Such a displacement is represented by the dotted line 144 in FIGS. 1 and 2. The expansion of the first refrigerant space 124 creates a vacuum capable of pulling the refrigerant through the cooling system, one direction valve 164, and into the first refrigerant space 124.

Alternately, because the reduction reaction is now taking place at the first electrode 142, the hydrogen gas in the second gas space 122 will be produced at the first electrode 142. As such reduction reaction occurs, hydrogen gas is produced and fills the second gas space 122. As more hydrogen gas is produced, the hydrogen gas causes the pressure in the second gas space 122 to increase. This pressure increase also increases the pressure on the face of the second flexible separator 108. Ultimately, the pressure inside the second gas space 122 will reach a point where the second flexible separator 108 will begin to flex and extend into the second refrigerant space 126 thereby expanding the second gas space 122 and compressing the refrigerant contained in the second refrigerant space 126. Such a displacement is represented by the dotted line 150 in FIGS. 1 and 2. This compression forces the refrigerant out of the second refrigerant space 126 and through the cooling system.

The polarity of the power supply 110 will reverse again. Once again, the hydrogen electrode 140 will become the cathode and produce hydrogen gas in a reduction reaction. Likewise, the first electrode 142 will become the anode and consume hydrogen gas in an oxidation reaction. The power supply 110 polarity can continually be reversed to manipulate the flexible separators 106, 108 in a cyclic manner.

As discussed above, the present invention includes two different embodiments. Both embodiments include the identical electrochemical pump 112 and gas-driven compressor 152 used to force the refrigerant through their respective refrigerant-based cooling systems 154, 254. However, the two embodiments differ with respect to their respective refrigerant-based cooling systems 154, 254. A discussion of the two embodiments utilizing the same electrochemical pump 112 and gas-driven compressor 152, but different refrigerant-based cooling systems 154, 254 follows.

In the first embodiment, as described in FIG. 1, the refrigerant-based cooling system 154 comprises a first condenser 128 in fluid communication with the first refrigerant space 124, a first throttle valve 130 in fluid communication with the first condenser 128, and an evaporator 132 in fluid communication with the first throttle valve 130, a second throttle valve 134 in fluid communication with the evaporator 132, and a second condenser 136 in fluid communication with the second throttle valve 134 and the second refrigerant space 126. The evaporator 132 is in thermal communication with an object to be cooled.

The refrigerant-based cooling system works in the following manner. As hydrogen gas is produced by the hydrogen electrode 140, the hydrogen gas enters the first gas space 120 forcing the flexible separator 106 to flex and extend into the first refrigerant space 124. The flexible separator 106 compresses the refrigerant, which begins as a vapor, contained in the first refrigerant space 124. Following the compression of the refrigerant, part of the refrigerant is liquefied and the remaining part is still a vapor. Upon compression, the mixture of liquid and vapor refrigerant is forced out of the first refrigerant space 124 and enters the first condenser 128 where the refrigerant is liquefied. The liquid refrigerant then passes through the first throttle valve 130 where the liquid refrigerant is expanded from the high condenser pressure to the low evaporator pressure. The liquid refrigerant then enters the evaporator 132. As the liquid refrigerant passes through the evaporator 132, the refrigerant evaporates into a vapor while absorbing heat from an object to be cooled as latent heat of evaporation.

After passing through the evaporator, the vapor refrigerant is pulled into the second refrigerant space 126. Because of the hydrogen consumption at the first electrode 142, there is a low absolute pressure in the second gas space 122. This low absolute pressure causes the second flexible separator 108 to flex and extend into the second gas space 122. The second flexible separator 108 expands the second refrigerant space 126 thereby creating a vacuum in the second refrigerant space 126. As the vapor refrigerant enters this second refrigerant space 126, the vacuum (low pressure) accelerates the evaporation process.

At this point in time, the polarity of the voltage at the electrical terminals 114, 116 of the power supply 112 is preferably reversed. The signal for reversing polarity may include a predetermined amount of time, a pressure differential between the first chamber 102 and the second chamber 104, or a predetermined pump voltage. In any case, the hydrogen electrode 140 that was producing hydrogen gas will immediately begin to consume hydrogen gas and the first electrode 142 that was consuming hydrogen gas will immediately begin to produce hydrogen gas. This polarity reversal causes the system to reverse its action.

Therefore, as hydrogen gas is being produced at the first electrode 142, the second gas space 122 will fill with hydrogen gas and force the second flexible separator 108 to flex and extend into the second refrigerant space 126. The second flexible separator 108 compresses the refrigerant, which begins as a vapor, contained in the second refrigerant space 126. Following the compression of the refrigerant, part of the refrigerant is liquefied and the remaining part is still a vapor. Upon compression, the mixture of liquid and vapor refrigerant is forced out of the second refrigerant space 126 and enters the second condenser 136 where the refrigerant is liquefied. The liquid refrigerant then passes through the second throttle valve 134 where the liquid refrigerant is expanded from the high condenser pressure to the low evaporator pressure. The liquid refrigerant then enters the evaporator 132. As the liquid refrigerant passes through the evaporator 132, the refrigerant evaporates into a vapor while absorbing heat from an object to be cooled as latent heat of evaporation.

After passing through the evaporator, the vapor refrigerant is pulled into the first refrigerant space 124. Because of the hydrogen gas consumption at the hydrogen electrode 140, there is a low absolute pressure in the first gas space 120. This low absolute pressure causes the first flexible separator 106 to flex and extend into the first gas space 120. The first flexible separator 106 expands the first refrigerant space 124 thereby creating a vacuum in the first refrigerant space 124. As the vapor refrigerant enters this first refrigerant space 124, the vacuum (low pressure) accelerates the evaporation process.

The polarity of the power supply 110 will reverse again. Once again, the hydrogen electrode 140 will become the cathode and produce hydrogen gas in a reduction reaction. Likewise, the first electrode 142 will become the anode and consume hydrogen gas in an oxidation reaction. The power supply 110 polarity can continually be reversed to manipulate the flexible separators 106, 108 in a cyclic manner.

During one complete cycle that includes the use of two condensers, heat may be removed from the system at two points during the heat exchange cycle. Because the refrigerant will pass through the condenser (forcing heat out of the system) and then through the evaporator (absorbing heat from the object to be cooled) on two occasions during a complete cycle (once in one direction, once in the other direction), this two condenser heat exchange system may be more efficient than previous heat exchange systems.

The electrochemical heat pump system of the present invention may also be used with only one chamber (not shown in Figs.). In this case, the electrochemical pump is the same as in the above description and includes a hydrogen electrode and a first electrode. A MEA separates the two electrodes. The chamber is the same as in the above description and includes a gas space, a refrigerant space, and a flexible separator that exists between the gas space and the refrigerant space and divides their contents. The hydrogen electrode extends into and is in fluid communication with the gas space of the chamber. Likewise, the first electrode extends into and is in fluid communication with a surge tank that preferably does not play an active part in the heat pump cycle. The refrigerant space of the chamber contains a refrigerant. The refrigerant-based cooling system comprises a condenser in fluid communication with the refrigerant space; a throttle valve in fluid communication with the condenser; and an evaporator in fluid communication between the throttle valve and the refrigerant space, said evaporator being in thermal communication with an object to be cooled.

The single chamber system works in the following manner. When applying a positive polarity to the hydrogen electrode, the electrode produces hydrogen gas that enters the gas space of the chamber. Conversely, when applying a negative polarity to the first electrode, the electrode consumes hydrogen gas in the surge tank. As hydrogen gas is produced by the hydrogen electrode, the hydrogen gas enters the first gas space forcing the flexible separator to flex and extend into the refrigerant space. The flexible separator compresses the refrigerant, which begins as a vapor, contained in the refrigerant space. Following the compression of the refrigerant, part of the refrigerant is liquefied and the remaining part is still a vapor. Upon compression, the mixture of liquid and vapor refrigerant is forced out of the refrigerant space and enters the condenser where the refrigerant is liquefied. The liquid refrigerant then passes through the throttle valve where the liquid refrigerant pressure is reduced. The liquid refrigerant then passes through the evaporator. As the liquid refrigerant passes through the evaporator, the refrigerant evaporates into a vapor while absorbing heat from an object to be cooled as latent heat of evaporation.

As soon as compression is complete, the polarity of the voltage applied to the electrochemical pump is reversed. Therefore, hydrogen gas begins to be consumed in the chamber by the hydrogen electrode and produced in the surge tank by the first electrode creating a vacuum in the chamber. After passing through the evaporator, the vapor refrigerant is pulled back into the refrigerant space of the chamber. Because of the hydrogen gas consumption at the first electrode, there is a low absolute pressure in the chamber. This low absolute pressure causes the flexible separator to flex and contract the gas space. The contraction of the gas space expands the refrigerant space and creates a vacuum in the refrigerant space of the chamber. As the vapor refrigerant enters this refrigerant space, the vacuum (low pressure) accelerates the evaporation process.

The heat exchange efficiency of this version is lower in comparison with the two chamber version described above because the electrochemical pump is idling for half of the cycle period. In other words, it takes one full cycle of this heat pump system to remove heat from the system, whereas in the first embodiment described above, heat was removed at two points through the use of two condensers. However, the reduced amount of hardware required in this one chamber device tray be preferable in certain applications.

In the preferred embodiment, as described in FIG. 2, the refrigerant-based cooling system 254 comprises a condenser 236 in fluid communication with the first and second refrigerant spaces 124, 126, a throttle valve 249 in fluid communication with the condenser 236, an evaporator 242 in fluid communication with the throttle valve 249 and the first and second refrigerant spaces 124, 126, and a first, second, third, and fourth one-directional valve 234, 238, 246, 244. The first one-directional valve 234 is in fluid communication with the first refrigerant space 124 and the condenser 236, and only permits fluid flow from the first refrigerant space 124 to the condenser 236. The second one-directional valve 238 is in fluid communication with the second refrigerant space 126 and the condenser 236, and only permits fluid flow from the second refrigerant space 126 to the condenser 236. The third one-directional valve 246 is in fluid communication with the first refrigerant space 124 and the evaporator 242, and only permits fluid flow from the evaporator 242 to the first refrigerant space 124. The fourth one-directional valve 244 is in fluid communication with the second refrigerant space 126 and the evaporator 242, and only permits fluid flow from the evaporator 242 to the second refrigerant space 126. The evaporator 242 is in thermal communication with an object to be cooled.

As hydrogen gas is produced by the hydrogen electrode 140, the hydrogen gas enters the first gas space 120 forcing the first flexible separator 106 to flex and extend into the first refrigerant space 124. The first flexible separator 106 compresses the refrigerant, which begins as a vapor, contained in the first refrigerant space 124. Following the compression of the refrigerant, part of the refrigerant is liquefied and the remaining part is still a vapor. Upon compression, the mixture of liquid and vapor refrigerant is forced out of the first refrigerant space 124 and through the first one-directional valve 234. The mixture of liquid and vapor refrigerant then enters the condenser 236 where the refrigerant is liquefied. The liquid refrigerant then passes through the throttle valve 249 where the liquid refrigerant is expanded from the high condenser pressure to the low evaporator pressure. The liquid refrigerant then enters the evaporator 242. As the liquid refrigerant passes through the evaporator 242, the refrigerant evaporates into a vapor while absorbing heat from an object to be cooled as latent heat of evaporation.

After passing through the evaporator, the vapor refrigerant is pulled through the fourth valve 244 into the second refrigerant space 126. Because of the hydrogen consumption at the first electrode 142, there is a low absolute pressure in the second gas space 122. This low absolute pressure causes the second flexible separator 108 to flex and extend into the second gas space 122. The second flexible separator 108 expands the second refrigerant space 126 thereby creating a vacuum in the second refrigerant space 126. As the vapor refrigerant enters this second refrigerant space 126, the vacuum (low pressure) accelerates the evaporation process.

At this point in time, the polarity of the voltage at the electrical terminals 114, 116 of the power supply 110 are preferably reversed. The signal for reversing polarity may include a predetermined amount of time, a pressure differential between the first chamber 102 and the second chamber 104, or a predetermined pump voltage. In any case, the hydrogen electrode 140 that was producing hydrogen gas will immediately begin to consume hydrogen gas and the first electrode 142 that was consuming hydrogen gas will immediately begin to produce hydrogen gas. This polarity reversal causes the system to reverse its action.

Once the polarity is reversed, hydrogen gas is produced at the first electrode 142 and hydrogen gas enters the second gas space 122 forcing the second flexible separator 108 to flex and extend into the second refrigerant space 126. The second flexible separator 108 compresses the refrigerant, which begins as a vapor, contained in the second refrigerant space 126. Following the compression of the refrigerant, part of the refrigerant is liquefied and the remaining part is still a vapor. Upon compression, the mixture of liquid and vapor refrigerant is forced out of the second refrigerant space 126 and through the second valve 238. The mixture of liquid and vapor refrigerant once again enters the condenser 236 where the refrigerant is liquefied. The liquid refrigerant then passes through the throttle valve 249 where the liquid refrigerant is expanded from the high condenser pressure to the low evaporator pressure. The liquid refrigerant then once again enters the evaporator 242. As the liquid refrigerant passes through the evaporator 242, the refrigerant evaporates into a vapor while absorbing heat from an object to be cooled as latent heat of evaporation.

After passing through the evaporator, the vapor refrigerant is pulled through the fourth valve 246 into the first refrigerant space 124. Because of the hydrogen gas consumption at the hydrogen electrode 228, there is a low absolute pressure in the first gas space 120. This low absolute pressure causes the first flexible separator 106 to flex and extend into the first gas space 120. The first flexible separator 106 expands the first refrigerant space 124 thereby creating a vacuum in the first refrigerant space 124. As the vapor refrigerant enters the first refrigerant space 124, the vacuum (low pressure) accelerates the evaporation process.

The polarity of the power supply 110 will reverse again. Once again, the hydrogen electrode 140 will become the cathode and produce hydrogen gas in a reduction reaction. Likewise, the first electrode 142 will become the anode and consume hydrogen gas in an oxidation reaction. The power supply 110 polarity can continually be reversed to manipulate the flexible separators 106, 108 in a cyclic manner.

This "converted" heat pump system with only one condenser may be more efficient than the two condenser embodiment described above. In one complete electrochemical hydrogen pump cycle (polarity reversed once), heated refrigerant passes through the condenser 236 and evaporator 242 twice and therefore may be able to transfer twice as much heat as the previously described embodiment.

Figure 3:
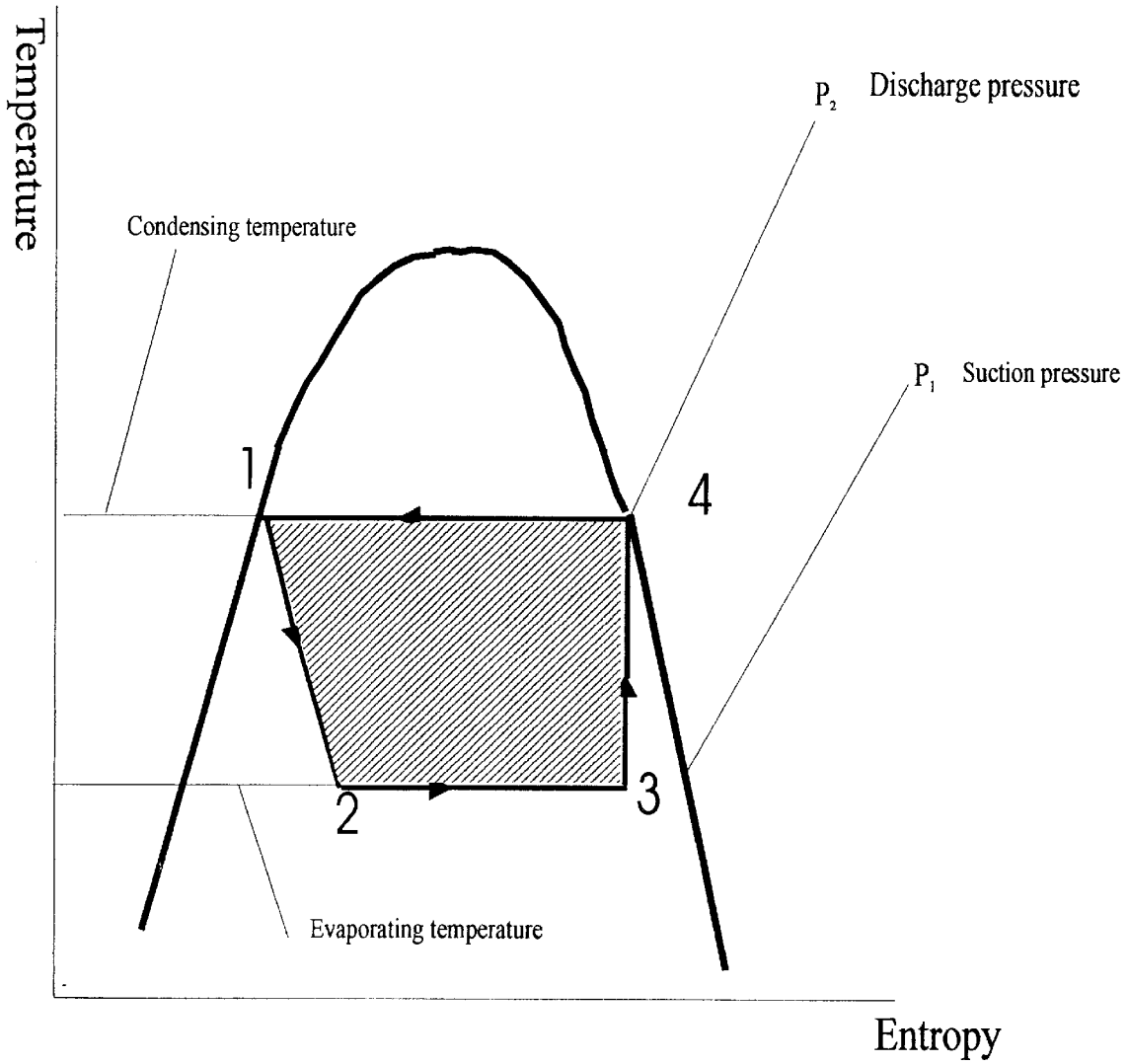
FIG. 3 illustrates the Rankine refrigeration cycle as used with the present electrochemical heat pump system.

FIG. 3 illustrates a temperature entropy diagram of Rankine cycle as used by the present invention. Specifically, FIG. 3 is a diagram of temperature versus entropy of the refrigerant vapor during a cycle of a heat exchange system according to the present invention. The diagram highlights the (at least nearly) isentropic and isothermal stages of the refrigerant during operation of the heat exchanger.

As the electrochemical pump operates, the hydrogen gas produced compresses the refrigerant (which is a vapor). As the vapor refrigerant is compressed, the temperature of the vapor increases. This process, shown as vertical line 3–4 in FIG. 3, is an isentropic process associated with rising temperature.

After reaching point 4, the superheated vapor is converted into a liquid by heat rejection in a condenser (according to line 4-1). This process is an isothermal process because the generated latent heat of condensation is rejected by the heat sink of the heat exchanger. Entropy decreases with rejecting latent heat of condensation.

As the cycle continues, the refrigerant undergoes adiabatic expansion (line 1–2) as it passes through the throttle valve. This adiabatic expansion is associated with decreasing temperature and increasing entropy of the refrigerant. The temperature drops because a portion of the energy is used for entropy rise.

Finally, in the evaporator, the mixture of refrigerant liquid and vapors expands under constant low temperature taking heat from the object to be cooled (according to line 2–3). This completes one cycle of the heat exchanger and the process can be repeated.

In any of the previously described embodiments, the first electrode may consist of a hydrogen, metal, metal-hydride, or metal-oxide electrode. A metal hydride-hydrogen pump works, for example, by employing metal-hydride-hydrogen chemistry ($MeH/KOH/H_2$). Hydrogen may be produced by applying positive polarity to a metal-hydride electrode and negative polarity to a hydrogen electrode. Changing the polarity preferably results in hydrogen consumption and electrochemical adsorption of hydrogen on metalhydride electrode.

The summary reaction is:

$$2MeH=2Me+H_2$$

The production of hydrogen results in the compression of refrigerant by means of diaphragm (separator) movement. The consumption of hydrogen is accompanied by pulling refrigerant vapor back into the chamber.

The present electrochemical heat pump system may provide benefits over the prior art. For example, a hydrogen—hydrogen symmetrical pump may realize $0.5A/cm^2$ current under 100 mV voltage. The current for MEA with a surface area of 10 $cm^2$ is 5A. This means that for one cell, the rate of hydrogen flow, which is equal to refrigerant flow, should be:

$$R=0.12\times5=0.6\times10^{-3}\,l/s=0.018\ GPM\ \text{(gallon per min)}$$

Therefore, the flow rate for a freon refrigerant that provides −5C. for a refrigerator cube with a space of 3 m×3 m×3 m should be $5.3\times10^{-3}$l/s under 9 at pressure. This requires a power o 150 W at a heat load of 540W. Thus, the coefficient of performance (COP) is:

$$COP=540/150=3.6$$

As such, an electrochemical pump connected to a series of eight MEA (each MEA being 10 $cm^2$) can provide this cooling effect.

The required power for the electrochemical cell is:

$$80\times0.1\times10=80\ W$$

$$COP=540/80=6.7$$

This calculation is made for an ideal cycle and does not take into consideration that real compression is not perfectly isentropic. Some mechanical and thermal losses within the heat exchanger have been ignored in these calculations. These effects may decrease the COP value by up to 25–30%.

According to the present invention, a method of cooling an object utilizing the electrochemical heat pump system includes producing hydrogen gas in a cathodic space, consuming hydrogen gas in an anodic space, forcing a vapor refrigerant into a condenser where the vapor refrigerant is liquefied and passing the liquid refrigerant through an evaporator to evaporate the liquid refrigerant by absorbing heat from an object to be cooled as latent heat of evaporation. The forcing step is accomplished by the production of the hydrogen gas. The method further comprises reversing the reactions in the cathodic and anodic gas spaces so that hydrogen gas is consumed in the cathodic space and hydrogen gas is produced in the anodic space.

While this invention has been described with respect to preferred embodiments, it will be appreciated that many variations, modifications and other applications of the invention may be made which are within the scope of the presently disclosed invention.

What is claimed is:

1. An electrochemical heat pump system comprising:

a reciprocal electrochemical pump having at least two electrochemical cells each containing a first electrode selected from the group consisting of a metal electrode, a metal-hydride electrode, and metal-oxide electrode and a hydrogen electrode wherein each of said hydrogen electrodes is capable of reversibly producing and consuming hydrogen gas during electrochemical reactions and each of said first electrodes is capable of reversibly producing or accepting at least one electron to support such electrochemical reactions;

a refrigerant-based cooling system;

a gas-driven compressor connected to said electrochemical pump and said cooling system, said compressor including a flexible member to physically isolate hydrogen gas in said gas-driven compressor from refrigerant in said cooling system; and wherein said gas-driven compressor comprises:

at least one chamber having a fixed volume; and said flexible member dividing said at least one chamber into a first gas space and a refrigerant gas space, said first gas space connected to said electrochemical pump and said first refrigerant space connected to said cooling system.

2. The electrochemical heat pump system of claim 1, further comprising:

a reversible electric power source comprising a first electrical terminal electrically connected to a first of said hydrogen electrodes and a second electrical terminal electrically connected to a second of said hydrogen electrodes, whereby reversing the polarity of said reversible electric power source reverses the electrochemical reactions taking place at each of said hydrogen electrodes.

3. The electrochemical heat pump system of claim 1, wherein said flexible member is selected from the group consisting of a metal diaphragm, a combination metallic and plastic diaphragm, and a plastic bellow.

4. The electrochemical heat pump system of claim 1, wherein said cooling system comprises:

a condenser connected to said compressor;

an expansion valve connected to said condenser; and an evaporator connected to said expansion valve and said compressor, said evaporator adapted to remove heat from an object to be cooled.

5. The electrochemical heat pump system of claim 1, wherein said at least two electrochemical cells are connected in series.

6. The electrochemical heat pump system of claim 1, wherein said hydrogen electrode and said first electrode of each electrochemical cell share the same gas space.

7. An electrochemical heat pump system comprising:

a first compressor including a first chamber having a fixed volume, said first chamber having a first flexible member dividing said first chamber into a first gas space and a first refrigerant space, said first refrigerant space being connected to said cooling system;

a second compressor including a second chamber having a fixed volume, said second chamber having a second flexible member for dividing said second chamber into a second gas space and a second refrigerant space, said second refrigerant space being connected to said cooling system;

a cooling system connected to said first refrigerant space and said second refrigerant space, said cooling system contains a refrigerant that circulates between said first refrigerant space, cooling system, and second refrigerant space; and an electrochemical pump connected to said first and second gas spaces, said electrochemical pump provides a supply of gas to said first gas space to move said first flexible member and compress said refrigerant in said first refrigerant space during a charge cycle, said electrochemical pump provides a supply of gas to said second gas space to move said second flexible member and compress said refrigerant in said second refrigerant space during a discharge cycle when the polarity to said electrochemical pump is reversed.

8. The electrochemical heat pump system of claim 7, wherein said first gas space is capable of expanding when gas is provided to said first gas space causing said first flexible member to extend into said first refrigerant space thereby compressing said refrigerant and forcing said refrigerant to discharge from said first refrigerant space and through said cooling system.

9. The electrochemical heat pump system of claim 7, wherein said second gas space is capable of expanding when gas is provided to said second gas space causing said second flexible member to extend into said second refrigerant space thereby compressing said refrigerant and forcing said refrigerant to discharge from said second refrigerant space and through said cooling system.

10. The electrochemical heat pump system of claim 7, wherein said first and second flexible members are selected from the group consisting of a metal diaphragm, a combination metallic and plastic diaphragm, and a plastic bellow.

11. The electrochemical heat pump system of claim 7, wherein said electrochemical pump is capable of reversibly producing and consuming hydrogen gas in electrochemical reactions.

12. The electrochemical heat pump system of claim 11, wherein said electrochemical pump comprises first and second electrochemical cells each containing a hydrogen electrode and a first electrode wherein each of said hydrogen electrodes is capable of reversibly producing and consuming hydrogen gas during electrochemical reactions and each of said first electrodes is capable of reversibly producing or accepting at least one electron to support such electrochemical reactions.

13. The electrochemical heat pump system of claim 12, further comprising:

a reversible electric power source comprised of a first electric terminal electrically connected to said hydrogen electrode of said first electrochemical cell and a second electric terminal electrically connected to said hydrogen electrode of said second electrochemical cell, wherein said hydrogen electrode of said first electrochemical cell produces hydrogen gas and said hydrogen electrode of said second electrochemical cell consumes hydrogen gas when a positive electrical current is applied to said hydrogen electrode of said first electrochemical cell and a negative electrical current is applied to said hydrogen electrode of said second electrochemical cell.

14. The electrochemical heat pump system of claim 13, wherein the consumption of hydrogen gas by said hydrogen electrode of said second electrochemical cell causes said second gas space to contract forcing said second flexible member to extend into said second gas space thereby expanding said second refrigerant space and creating a vacuum capable of suctioning said refrigerant through said cooling system and into second refrigerant space.

15. The electrochemical heat pump system of claim 12, whereby reversing the polarity of said reversible electric power source causes said hydrogen electrode of said first electrochemical cell to consume hydrogen gas and said hydrogen electrode of said second electrochemical cell to produce hydrogen gas.

16. The electrochemical heat pump system of claim 15, wherein the consumption of hydrogen gas by said hydrogen electrode of said first electrochemical cell causes said first gas space to contract forcing said first flexible member to extend into said first gas space thereby expanding said first refrigerant space and creating a vacuum capable of suctioning said refrigerant through said cooling system and into first refrigerant space.

17. The electrochemical heat pump system of claim 12, wherein said first electrode is selected from the group consisting of a hydrogen electrode, metal electrode, metal-hydride electrode, and metal oxide electrode.

18. The electrochemical heat pump system of claim 7, wherein said cooling system comprises:

a condenser connected to said first refrigerant space of said first compressor and said second refrigerant space of said second compressor;

an evaporator connected to said condenser, first refrigerant space of said first compressor, and second refrigerant space of said second compressor, said evaporator adapted to remove heat from an object to be cooled; and an expansion valve connected to said condenser and said evaporator.

19. The electrochemical heat pump system of claim 18, wherein said cooling system further comprises:

a first check valve connected between said first refrigerant space and said condenser, said first check valve permitting fluid flow only from said first refrigerant space to said condenser;

a second check valve connected between said second refrigerant space and said condenser, said second check valve permitting fluid flow only from said second refrigerant space to said condenser;

a third check valve connected between said first refrigerant space and said evaporator, said third check valve permitting fluid flow only from said evaporator to said first refrigerant space; and a fourth check valve connected between said second refrigerant space and said evaporator, said fourth check valve permitting fluid flow only from said evaporator to said second refrigerant space.

* * * * *